US005979394A

United States Patent [19]

Schmidt

[11] Patent Number: 5,979,394

[45] Date of Patent: Nov. 9, 1999

[54] METHOD OF OPERATING A PISTON-TYPE INTERNAL COMBUSTION ENGINE

[75] Inventor: Fritz Schmidt, Waiblingen, Germany

[73] Assignee: DaimlerChrysler AG, Stuttgart, Germany

[21] Appl. No.: 09/082,970

[22] Filed: May 21, 1998

[30] Foreign Application Priority Data

May 24, 1997 [DE] Germany ..... 197 21 756

[51] Int. Cl.[6] ..... F01P 3/02

[52] U.S. Cl. ..... 123/198 F; 123/41.44

[58] Field of Search ..... 123/198 F, 41.44, 123/41.72, 41.29

[56] References Cited

U.S. PATENT DOCUMENTS 5,454,356 10/1995 Kawamura .

FOREIGN PATENT DOCUMENTS 0 499 071 8/1992 European Pat. Off. .

42 36 009 4/1994 Germany .

*Primary Examiner*—Noah P. Kamen

*Assistant Examiner*—Jason Benton

*Attorney, Agent, or Firm*—Klaus J. Bach

[57] ABSTRACT

In a method of operating a piston-type internal combustion engine including cylinders with gas exchange valves of which at least some are closed when the engine is operated in an engine-driven state above a predetermined engine speed and the engine includes an electrically operated coolant circulating pump wherein the coolant circulating pump speed is controlled depending on the number of cylinders shut down during operation in the engine driven state.

5 Claims, 1 Drawing Sheet

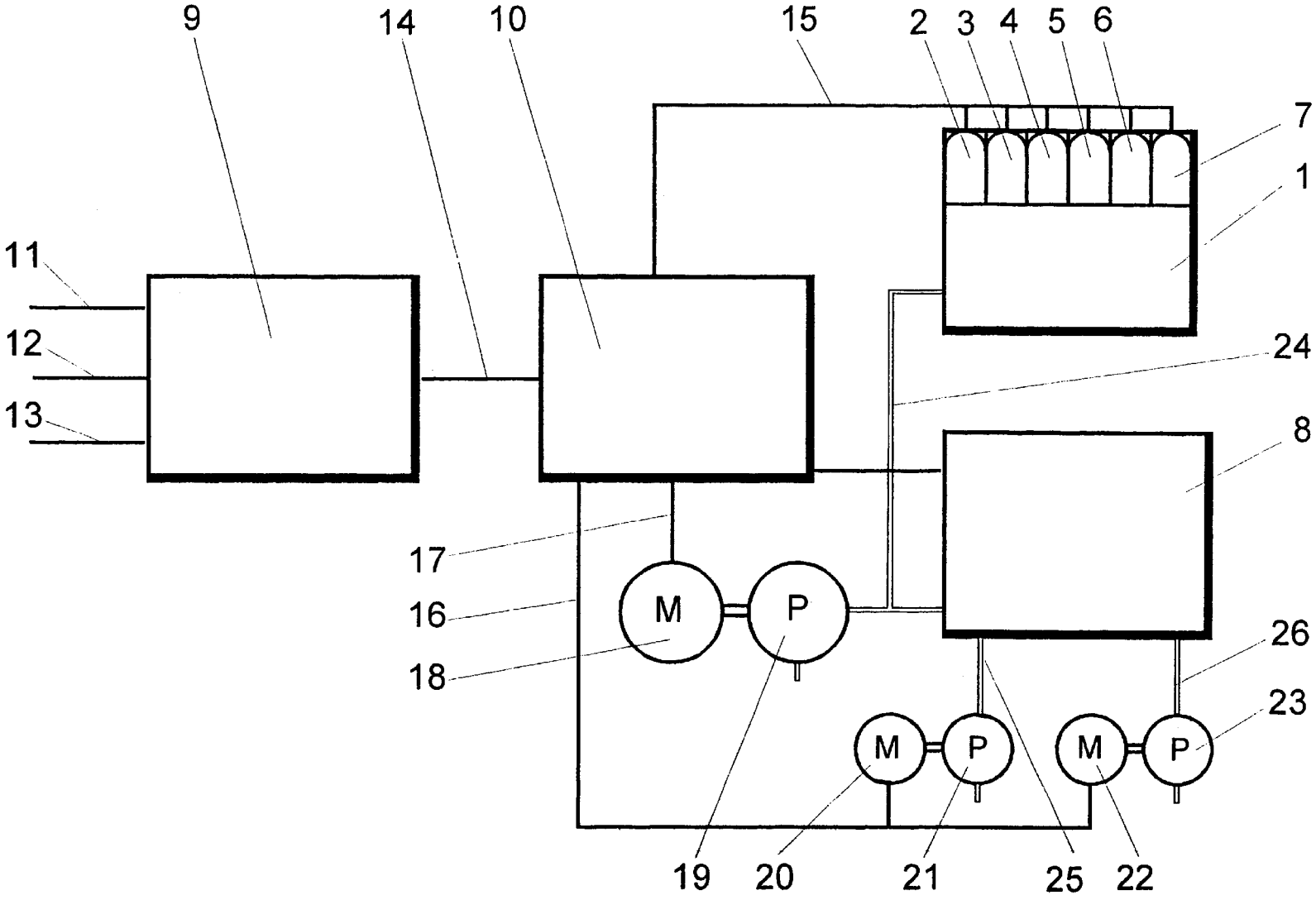
7
1
24
8
26
23
6
5
4
3
2
15
22
25
21
20
19
P
M
P
M
P
M
10
14
9
17
16
18
11
12
13

METHOD OF OPERATING A PISTON-TYPE INTERNAL COMBUSTION ENGINE

BACKGROUND OF THE INVENTION

The invention relates to a method of operating a piston-type internal combustion engine with electromagnetically operated intake and exhaust valves, which, in an engine driven phase above a predetermined engine speed, are all closed at least for one cylinder in order to generate a reduced braking torque.

Environmental factors, noxious emissions and the depletion of fossil fuel resources make it necessary for new power generation concepts to save fuel by increasing the efficiency of the combustion processes of piston internal combustion engines in order to avoid unnecessary energy losses. It is, for example, possible to operate the power plant of a motor vehicle that is, generally, its piston-type internal combustion engine in an intermittent manner by disconnecting the engine from the drive line when the vehicle is in an engine-driven phase and shutting the engine down in such a phase. However, since the engine generally does not only drive the vehicle, but also numerous auxiliary components depend on engine operation such as the cooling and the lubrication system, the electric power supply, the power steering and the power brakes, the intermittent engine operation detrimentally affects these functions. Measures must therefore be taken which compensate for such effects. These measures are generally very expensive under economical and ecological considerations so that, mathematically, a positive result is obtained only after a long period of operation.

It is the object of the present invention to reduce the distance or the amount of time required for an internal combustion engine of vehicles to make economical or ecological measures worthwhile their costs.

SUMMARY OF THE INVENTION

In a method of operating a piston-type internal combustion engine including cylinders with gas exchange valves of which at least some are closed when the engine is operated in an engine-driven state above a predetermined engine speed and the engine includes an electrically operated coolant circulating pump wherein the coolant circulating pump speed is controlled depending on the number of cylinders shut down during operation in the engine driven state.

The method according to the invention is based on an internal combustion engine with electromagnetically operated intake and exhaust valves.

DE 4,236,009A1 discloses a method of controlling such internal combustion engines, whereby during engine-driven operation the engine can be so controlled that it operates in an optimal manner that is with the lowest possible retarding torque as long as braking is not desired. As soon as engine braking is desired, the air mass flow through the internal combustion engine is adjusted for maximum braking torque.

Such a method has the advantage that the braking losses of the internal combustion engine during engine-driven operation which may be high particularly in internal combustion engines with quantity control, that is, with gasoline engines, are greatly reduced without interrupting the drive connection with the auxiliary aggregates. As a result, the auxiliary aggregates driven by the internal combustion engine remain fully operational also during engine-driven operation of the vehicle.

In addition, friction losses are avoided which are generally present when the intake and exhaust valves of an engine are driven mechanically by a cam shaft. Furthermore, the magnetic intake and exhaust valves can be accurately controlled exactly and practically without delay whereby particular cylinders of the internal combustion engine can be timely switched off or particular cylinders of the engine can be sequentially controlled, that is, they can be switched off or on as desired in a sequential manner.

The method according to the invention also takes into consideration that, in an operating state of the internal combustion engine in which no power for the operation of the vehicle is required and in which the braking power of the internal combustion engine is greatly reduced, also the cooling water flow to be generated by a water pump can be greatly reduced. For this reason, an electric motor driven water pump is provided whose speed is reduced corresponding to the number of cylinders which are inactivated.

A cooling system for a vehicle with an internal combustion engine and an electric motor operated speed controlled coolant pump is known from EP 0 499 071 A. The speed of the motor is controlled dependent on the coolant temperature and temperatures of various components. However, since heat transfer is relatively slow, the control acts only in a much delayed manner. In contrast, with the method according to the invention, the cooling pump motor is controlled with changing engine load, that is, it is properly adjusted already before the heat is transferred to the components or, respectively, the coolant. Consequently, the control is practically delay-free.

With the method according to the invention, not only the drive energy for the cooling water pump during engine driven operation and, consequently, power losses are reduced but sub-cooling of the engine during engine-driven operation is avoided so that, at the end of the engine driven operation, optimal engine operating temperatures are rapidly achieved, whereby the average engine efficiency is improved.

Since, during engine-driven operation, the temperatures of the internal combustion engine are not critical for cooling, it is advantageous in accordance with a particular embodiment of the invention to adjust the pump-water speed primarily depending on the requirements and critical temperatures of the normally cooled or, respectively, heated aggregates, such as the brakes, a retarder, a passenger space heater, an air conditioning system, a braking energy regeneration system etc. In some cases, it may also be appropriate to shut down the coolant flow through the internal combustion engine by completely shutting down the water pump during engine-driven operation and providing for the cooling and heating of the various aggregates separate relatively small, also electrically operated, auxiliary pumps.

The method according to the invention is considered to be useful especially for internal combustion engines employing a quantity control, wherein during normal operation the braking power is especially high. But the method can also be used advantageously in connection with internal combustion engines having a quality control, that is, with Diesel engines. In this application, however, all cylinders are rarely shut down at one time. More often only some of the cylinders are shut down whereas the others operate at higher efficiency with a higher mean pressure. In Diesel engines with prechambers, it is known (for example, U.S. Pat. No. 5,454,356) that the communication passages between the prechambers and the main combustion chambers are controlled by an electromagnetic valve in order to reduce the excess charge losses between the prechambers and the main combustion chambers. With such internal combustion engines, it is advantageous in accordance with an embodiment of the invention to close the electromagnetic valves when all the intake and exhaust valves of the respective cylinders remain closed during engine driven operation. Then the pumping losses occurring by the gas flow in and out of the prechamber during engine driven operation are avoided.

If the vehicle must be braked, it is advantageous to regenerate the braking energy by electrical equipment, which is activated as the cylinders are deactivated and a braking signal is provided. With such equipment, electrical storage devices and heat storage devices can be recharged.

Further advantages and particular features of the invention will be apparent from the following description of an embodiment on the basis of the accompanying drawings. In the description and in the claims various features are presented in a particular combination which is considered to be particularly suitable for an understanding of the invention.

BRIEF DESCRIPTION OF THE DRAWINGS

The sole FIGURE shows a block diagram incorporating the method according to the invention.

DESCRIPTION OF A PREFERRED EMBODIMENT

As shown in the FIGURE, an internal combustion engine 1 with six cylinders 2–7 includes electromagnetically operated gas change valves (intake and exhaust valves), which are individually controlled by a control unit 10 by way of a control line 45. The control unit 10 is connected by way of a signal transmission line 14 to a vehicle operating state determination unit 9 which, by way of sensor lines 11, 12, 13 determines the vehicle operating state from the position of a gas pedal, a brake pedal or an inclination sensor. Depending on the vehicle operating state, a number of cylinders 2–7 is shut down by closing the gas change valves and interrupting the fuel supply thereto.

A water pump 19 operated by an electric motor 18 is provided for the cooling of the internal combustion engine 1 and for the cooling and heating of additional aggregates 8. These may comprise a retarder, a transmission cooler, a passenger space heater, an air conditioning system or an apparatus for regenerating braking energy. A coolant duct 24 connects the pump 19 with the internal combustion engine 1 and also with the other aggregates 8.

When some or all of the cylinders 21 are shut down, the speed of the water pump 19 is reduced by sending an appropriate control signal from the control unit 10 to the electric motor 18 by way of the signal line 17. In this way, on one hand, the power consumption of the water pump 19 is reduced and, on the other hand, the internal combustion engine 1 does not cool down so fast during engine driven operation.

There may be provided additional electric motors 20, 22 with auxiliary pumps 21, 23 for heating or cooling media which are controllable by way of a signal line 16. These pumps supply cooling or heating fluid to the additional aggregates 8 by way of liquid pipes 25, 26. If all the cylinders 2–7 are shut down so that cooling of the internal combustion engine 1 is not necessary, the electric motor 18 for the cooling water circulation pump 19 can be fully de-energized. The coolant or heating fluid supply for the additional aggregates 8 is then accommodated exclusively by the additional pumps 21, 23.

What is claimed is:

1. A method of operating a piston-type internal combustion engine having cylinders with intake and exhaust valves of which the valves of at least some cylinders are closed during engine driven operation above a predetermined engine speed and an electrically operated coolant circulation pump, said method comprising the step of controlling the speed of the electrically operated coolant circulating pump depending on the number of cylinders shut down during engine driven operation.

2. A method according to claim 1, wherein, when, during engine driven operation, all the valves of all the cylinders ofthe internal combustion engine are kept closed, the coolant circulation pump speed is controlled depending on critical aggregate temperatures.

3. A method according to claim 2, wherein the coolant circulating pump is fully shut down and cooling or heating of said aggregates is obtained by controlling electrically operated auxiliary pumps associated with said aggregates.

4. A method according to claim 1, wherein said internal combustion engine is a Diesel engine with a prechamber in communication with a main combustion chamber by a passage including a valve and said valve is closed when, during engine driven operation, all the gas change valves of the respective engine cylinder are closed.

5. A method according to claim 1, wherein an electric regenerator is provided for the recuperation of vehicle braking energy and said electric regenerator is activated as soon as the cylinders are all deactivated (gas exchange valves remain closed) and a braking signal is present.

* * * * *